United States Patent [19]

Schmoock

[11] 4,315,209

[45] Feb. 9, 1982

[54] TEMPERATURE COMPENSATED VOLTAGE REFERENCE CIRCUIT

[75] Inventor: James C. Schmoock, San Jose, Calif.

[73] Assignee: Raytheon Company, Lexington, Mass.

[21] Appl. No.: 168,788

[22] Filed: Jul. 14, 1980

[51] Int. Cl.[3] ..... G05F 3/20

[52] U.S. Cl. ..... 323/313; 323/907

[58] Field of Search ..... 323/231, 311, 312, 313, 323/907; 307/296 R, 297, 302

[56] References Cited

U.S. PATENT DOCUMENTS

| | | | |
|---|---|---|---|
| 3,701,004 | 10/1972 | Tuccinardi et al. | 323/313 X |
| 4,030,023 | 6/1977 | Keith | 323/313 |
| 4,063,147 | 12/1977 | Hatanaka et al. | 323/313 |

OTHER PUBLICATIONS

Article entitled "Circuit Techniques for Achieving High-Speed Resolution A/D Conversion" by Holloway and Timko in the 1979 IEEE International Solid State Circuits Conference, Digest of Technical Papers, pp. 136–137.

*Primary Examiner*—William M. Shoop

*Assistant Examiner*—Peter S. Wong

*Attorney, Agent, or Firm*—Richard M. Sharkansky; Joseph D. Pannone

[57] ABSTRACT

A temperature compensated voltage reference circuit wherein a first circuit is provided for producing an output voltage at an output terminal, such circuit including a reference voltage device connected between a predetermined voltage potential and the output terminal, such reference voltage device producing a reference voltage which varies with temperature over a predetermined range of temperatures. A temperature compensation circuit is included which, in response to a compensating current, produces a compensating voltage in series with the reference voltage, such compensating voltage varying inversely to the voltage variation of the reference voltage over the predetermined range of temperatures, such compensating current passing serially through the reference voltage device and the compensating voltage producing means. With such arrangement a relatively simple temperature compensated voltage reference circuit is provided, such circuit being adapted to produce an output voltage relatively close in value to the voltage produced by the reference voltage device.

8 Claims, 2 Drawing Figures

TEMPERATURE COMPENSATED VOLTAGE REFERENCE CIRCUIT

BACKGROUND OF THE INVENTION

This invention relates generally to temperature compensated voltage reference sources, and more particularly to temperature compensated voltage references sources which include Zener diodes.

As is known in the art, voltage reference sources have application in a wide variety of electronic circuits such as analog-to-digital converter circuits and voltage-to-frequency converter circuits, for example. One type of voltage reference source includes a Zener diode, having its breakdown junction formed beneath the surface of a semiconductor layer which provides a portion of an integrated circuit. One such Zener diode is discussed in an article entitled "$I^2L$ puts it all together for 10-bit a-d converter chip" by Paul Brokaw, published in *Electronics,* Apr. 13, 1978 on pages 99–105. One special type of such buried Zener diode is a so-called "Kelvin Buried Zener" diode, such diode being characterized by having a sense terminal anode and a force terminal anode in addition to its cathode electrode. As discussed in an article entitled "Circuit Techniques For Achieving High-Speed Resolution A/D Conversion" by Peter Holloway and Michael Timko in the 1979 IEEE International Solid State Circuits Conference, Digest of Technical Papers, pages 136–137, such Kelvin Buried Zener diode has been found to have a temperature coefficient which varies with the processing in a way which correlates with the variation in its Zener breakdown voltage. This relationship was used to provide a temperature compensated buried Zener voltage reference source. In particular, as described in such latter article, the variation in Zener breakdown voltage as a function of temperature was plotted for a number of Zener diodes and it was determined that all curves intersected at a common point or "temperature", $T_K$. A compensation network was designed to add a voltage, $V_{COMP}$, to the Zener breakdown voltage $V_Z$ in such a way that the resulting output voltage, $V_0$, had a zero temperature coefficient. This was done by making a family of $V_{COMP}$ versus temperature curves produced by trimming a pair of resistors in the circuit so that the compensation curves had a common intercept at the same point or "temperature", $T_K$, as the common intercept point of the Zener diodes referred to above. The resulting circuit included the use of a differential amplifier having one input fed by the sense electrode of a Kelvin buried Zener diode (i.e. the voltage $V_Z$) and a second input fed by the compensating network (i.e. the voltage $V_{COMP}$).

While the circuit described in the latter article provides temperature compensation for the buried Zener diode, the circuit is relatively complex in its use of a differential amplifier and further the circuit is limited in the range of obtainable reference voltages.

SUMMARY OF THE INVENTION

In accordance with the present invention a voltage reference circuit is provided wherein a first circuit is provided for producing an output voltage at an output terminal, such circuit including a reference voltage device connected between a predetermined voltage potential and the output terminal, such reference voltage device producing a reference voltage which varies with temperature over a predetermined range of temperatures. A temperature compensation circuit is included which, in response to a compensating current, produces a compensating voltage in series with the reference voltage, such compensating voltage varying inversely to the voltage variation of the reference voltage over the predetermined range of temperatures, such compensating current passing serially through the reference voltage device and the compensating voltage producing means. With such arrangement a relatively simple temperature compensated voltage reference circuit is provided, such circuit being adapted to produce an output voltage relatively close in value to the voltage produced by the reference voltage device.

In a preferred embodiment of the invention such voltage reference circuit includes a current source coupled to a first terminal for supplying a predetermined amount of current to such first terminal. An output voltage producing means, coupled between the first terminal and an output terminal, produces an output voltage related to the amount of current flow from the first terminal to the output voltage producing means. A current regulating circuit means is coupled between the output terminal and the first terminal for controlling the amount of flow of current from the first terminal to the output voltage producing means in accordance with the output voltage produced at the output terminal. The current regulating means includes the reference voltage device serially coupled between the output terminal and a predetermined voltage potential. The output voltage is related to the reference voltage produced by the reference voltage device. The reference voltage varies with temperature over a predetermined range of temperatures. A temperature compensating circuit means is provided and is coupled to the output terminal and to the reference voltage device for producing a compensating voltage in series with the reference voltage produced by the reference voltage device, such produced compensating voltage varying in temperature over the predetermined range inversely to the temperature variation of the reference voltage means, such compensating voltage being produced in response to a compensating current flowing serially through both the temperature compensating circuit means and the reference voltage device.

In the preferred embodiment of the invention the voltage reference device is a Kelvin Buried Zener diode, such Zener diode having a cathode and a sense terminal anode electrode serially coupled between the output terminal and a transistor. The transistor has a base electrode, an emitter electrode and a collector electrode, the base electrode and one of such emitter and collector electrodes being serially coupled to the sense terminal anode and cathode of the Zener diode. The temperature compensation circuit includes: A first resistor serially coupled between the output terminal and a force terminal anode electrode of the Zener diode; a second transistor having collector and emitter electrodes serially connected to the serially connected first resistor and the sense terminal anode electrode of the Zener diode; and a second resistor serially coupled to the serially connected collector and emitter electrodes of the second transistor. Such first and second resistors are selected in accordance with the temperature coefficient of the Zener diode. A voltage divider circuit is included in the temperature compensation circuit and is coupled between the output terminal and the base electrode of the second transistor, such voltage divider circuit having a resistor means selected to provide a substantially constant reference voltage at the output terminal at a preselected temperature independent of the resistances of the first and second resistors.

BRIEF DESCRIPTION OF THE DRAWINGS

The foregoing aspects and other features of the invention are explained in the following description taken in connection with the accompanying drawings where.

DESCRIPTION OF THE PREFERRED EMBODIMENT

Figure 1:
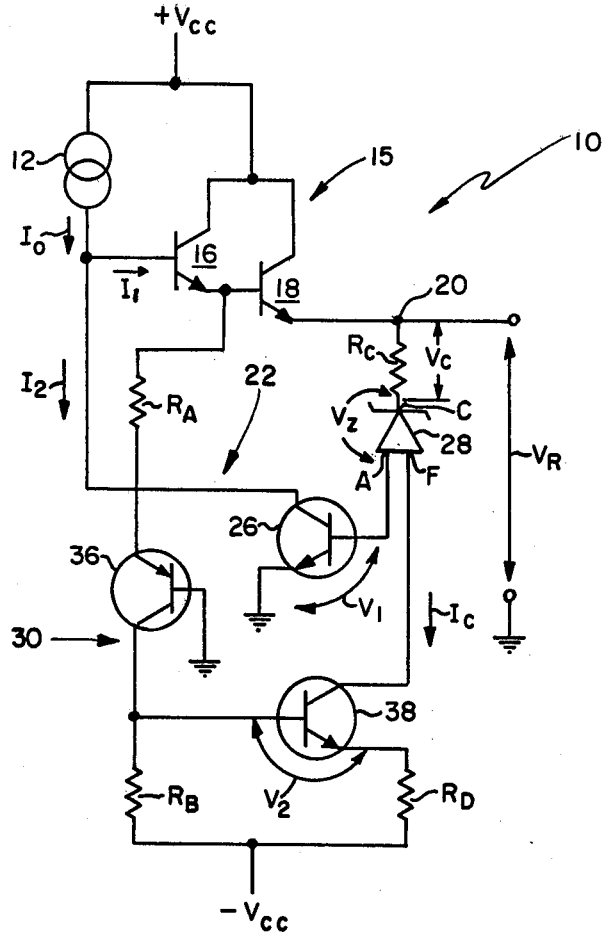
FIG. 1 shows the schematic diagram of a voltage reference circuit in accordance with the invention and FIG. 2 shows the Zener voltage as a function of temperature for a plurality of Zener diodes.

Referring now to FIG. 1, a temperature compensated voltage source circuit 10 is shown to include a current source 12 coupled between a $+V_{CC}$ voltage source (here +15 volts) and a first terminal 14 for producing a predetermined current flow to the first terminal 14. A voltage producing circuit 15, here including a pair of transistors 16, 18 connected as a Darlington pair, is coupled between the first terminal 14 and an output terminal 20, as shown. The voltage producing circuit 15 produces a voltage at the output terminal 20, $V_R$, related to the current flow $I_1$ from the first terminal 14 to the base electrode of transistor 16. A current flow regulating circuit 22, including a transistor 26 and a Kelvin Buried Zener diode 28, is coupled between the output terminal 20 and the first terminal 14 for controlling the amount of current flow from the first terminal 14 to the voltage regulating circuit 22, i.e. the current $I_2$, in accordance with the voltage $V_R$ produced at the output terminal 20. Since the current flow $I_1$ to the voltage producing circuit 15 is equal to $I_0$–$I_2$, the voltage regulating circuit 22 maintains the voltage $V_R$ at a constant predetermined level. More particularly, if the reference voltage $V_R$ tends to decrease because of requirements of a load (not shown) connected to output terminal 20, the current $I_2$ fed to the collector electrode of transistor 26 decreases. Hence, since $I_1=I_0-I_2$, the current flow $I_2$ increases causing the voltage at the base electrode of transistor 16 to become more positive, thereby increasing the voltage at output terminal 20 and maintaining the voltage $V_R$ at a constant predetermined level. On the other hand, if the voltage $V_R$ tends to increase, the current $I_2$ increases and the current $I_1$ decreases thereby tending the voltage at the base electrode of transistor 16 more negative and thereby in turn tending to lower the output voltage $V_R$ so as to maintain the voltage $V_R$ at the predetermined constant level. The voltage at terminal 20 is related to a breakdown or reference voltage $V_Z$ produced by the Zener diode 28 across its sense terminal anode (A) and cathode (C) electrodes and because such breakdown voltage $V_Z$ varies with temperature T over a predetermined range of temperature a temperature compensating circuit 30 is provided for producing a compensating voltage $V_C$ across a resistor $R_C$ in series with the voltage $V_Z$, such compensation voltage $V_C$ varying in temperature over the range of temperatures inversely from the temperature variation of the Zener breakdown voltage $V_Z$. The temperature compensation circuit 30 includes, in addition to the resistor $R_C$, a voltage divider circuit, such divider circuit including a resistor $R_A$, a transistor 36, a transistor 38 and a pair of resistors $R_B$ and $R_D$, as shown.

Figure 2:
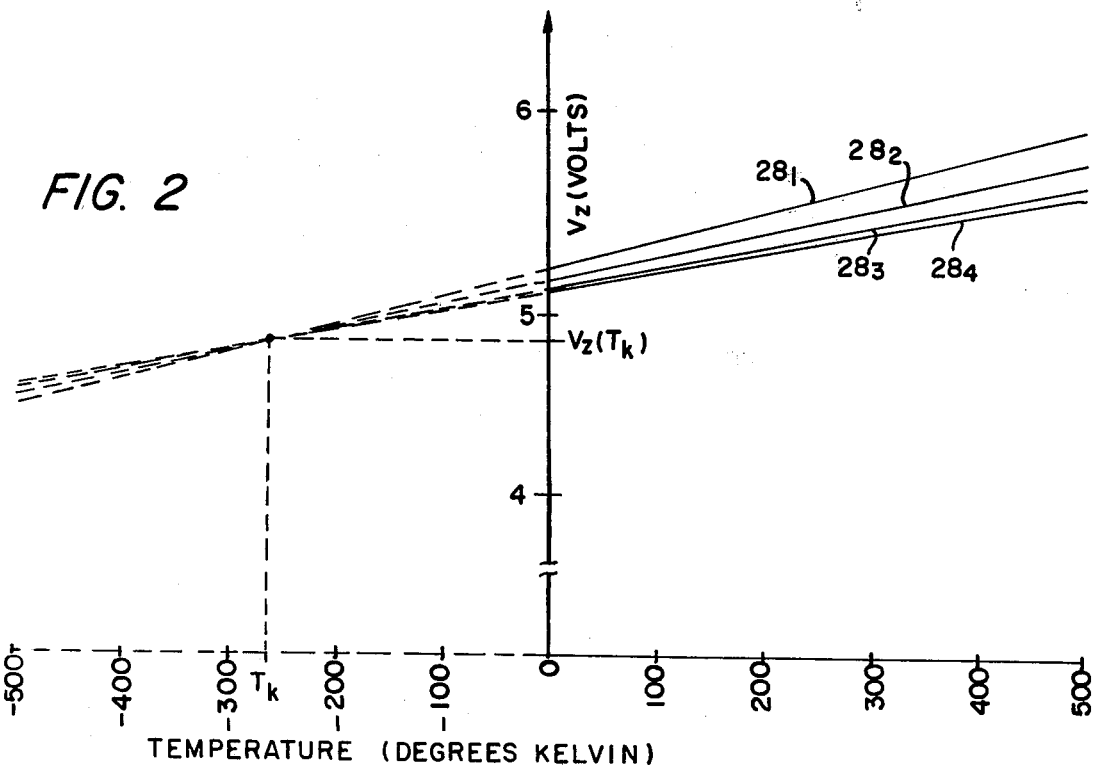

Referring now briefly to FIG. 2, the variation in breakdown voltage $V_Z$ as a function of temperature is shown for a plurality of Zener diodes $28_1$–$28_4$. It is noted that each of the diodes $28_1$–$28_4$ has the same "breakdown voltage" V ($T_K$) at substantially the same point, or "temperature", $T_K$. It is noted that the common point or "temperature" $T_K$ is imaginary and results from projections (shown dotted) of the Zener voltage vs temperature curves (shown solid). Each one has a different temperature coefficient $S_Z$ (here $S_{Z1}$–$S_{Z4}$) such that the voltage of each of the Zener diodes $28_1$–$28_4$, as a function of temperature T, may be expressed as $$V_Z(T)=V_Z(T_K)+S_Z(T-T_K) \qquad \text{Eq. (1)}$$

where $T>0°$ K.;

where here $V_Z(T_K)=4.8$ volts and $T_K=-250°$ K., the temperature coefficients $S_Z$ being:

$S_{Z1}=1.753$ mV/°K.; $S_{Z2}=1.461$ mV/°K.; $S_{Z3}=1.292$ mV/°K.; $S_{Z4}=1.223$ mV/°K. for diodes $28_1$–$28_4$, respectively.

Referring again to FIG. 1 it is noted that the output voltage $V_R$ as a function of temperature (T) may be expressed as:

$$V_R(T)=V_C(T)+V_1(T)+V_Z(T) \qquad \text{Eq. (2)}$$

where:

$V_1(T)$=voltage between the base and emitter junctions of transistor 26 as a function of temperature, T; and $V_C(T)$ is the voltage developed across resistor $R_C$ as a function of temperature, T. Since the transistors 16, 18, 26, 36 and 38 are matched, being formed on the same single crystal substrate, here a silicon substrate (not shown) using conventional integrated circuit techniques, the voltages between the base and emitter junctions of transistors 18 and 36 are equal to each other and hence the voltage at the base electrode of transistor 38 is approximatley $V_R(R_B/R_A)$ where $R_A$ is the resistance of resistor $R_A$ connected between the emitter of the grounded base electrode transistor 36 and the base of transistor 18, and $R_B$ is the resistance of a resistor $R_B$ connected between a $-V_{CC}$ supply (here −15 volts) and the base and collector electrodes of transistors 38, 36, as shown. It follows then that the voltage developed across the resistor $R_D$ (i.e. the resistor connected between the emitter electrode of transistor 38 and the $-V_{CC}$ supply) may be expressed as $$V_D=[V_R(R_B/R_A)-V_2(T)] \qquad \text{Eq. (3)}$$

where $V_2(T)$ is the voltage produced across the base-emitter junction of transistor 38 as a function of temperature.

It follows, then, that the current through resistor $R_D$, (which is substantially equal to the compensation current through the collector electrode, here $I_C$, since the base current of transistor 38 is substantially zero) may be represented as:

$$I_C=V_D/R_D=[V_R(R_B/R_A)-V_2(T)]/R_D \qquad \text{Eq. (4)}$$

Further, since the current flow into the base electrode of transistor 26 is substantially zero, substantially all of the current $I_C$ flows serially through both the resistor $R_C$ and the Zener diode 28 (i.e. between the cathode electrode and the force terminal anode electrode (F)) so that the voltage $V_C$ may be expressed as:

$$V_C=I_CR_C=R_C[V_R(R_B/R_A)-V_2(T)]/R_D \qquad \text{Eq. (5)}$$

Further, since transistors 26 and 38 are matched:

$$V_1(T)=V_2(T)=V_1(T_K)+S_T(T-T_K) \quad \text{Eq. (6)}$$

where $V_1(T_K)$ is the voltage between the base and emitter junction of each of the transistors 26 and 38 and where $S_T$ is the temperature coefficient of such base-emitter junction.

Substituting Equations (1), (5) and (6) into Equation (2), Eq. (2) may be rewritten as:

$$V_R=R_C[(R_B/R_A)V_R-V_1(T_K)-S_T(T-T_K)]/R_D+V_1(T_K)+2S_T(T-T_K)+V_Z(T_K)+S_Z(T-T_K) \quad \text{Eq. (7)}$$

In order for $V_R$ to be invarient with temperature, from Eq. (7):

$$-R_CS_T/R_D+S_T=-S_Z \quad \text{Eq. (8)}$$

or rewritting Equation (8)

$$R_C/R_D=[S_T+S_Z]/S_T \quad \text{Eq. (9)}$$

That is, from Equation (8); since the temperature coefficient $S_T$ has a substantial constant value independent of processing, i.e., $S_T=-2.0$ mV/°K., once the temperature coefficient $S_Z$ is measured the ratio of the resistors $R_C/R_D$ is selected so that Equation (9) is satisfied.

The next requirement is to have the circuit 10 produce the same preselected reference voltage $V_R$ regardless of the temperature coefficient $S_Z$ of the Zener diode 28. Therefore, if $R_C/R_D$ is selected in accordance with Equation (9), reference voltage $V_R$ as expressed in Equation (7) will be invariant with temperature and hence Eq. (7) may be rewritten as:

$$V_R=(R_CR_BV_R/R_DR_A)-(R_CV_1(T_K)/R_D)+V_1(T_K)+V_Z(T_K) \quad \text{Eq. (10)}$$

From Equation (10) it is noted that $V_R$ is a function of $R_B/R_A$ and $R_C/R_D$. It is desired, however, to select the ratio $R_B/R_A$ such that the reference voltage $V_R$ is independent of the ratio $R_C/R_D$. In this way the resistor $R_C$ may be adjusted, as with conventional laser trimming techniques, so that for a given $R_B/R_A$ ratio (and for a fixed $R_D$) its value may be changed without affecting the reference voltage $V_R$. Therefore the value $R_C$ is selected only in accordance with the temperature coefficient of the Zener diode, i.e. $S_Z$, as described in connection with Equation (9).

Consequently, rewriting Eq. (10) as a function of $R_B/R_A$:

$$R_B/R_A=[V_R+(R_C/R_D)V_Z(T_K)-V_1(T_K)-V_Z]/(R_C/R_D)V_R \quad \text{Eq. (11)}$$

From Equation (11) it is noted that if:

$$V_R-V_1(T_K)-V_Z(T_K)=0, \text{ then}$$

$$R_B/R_A=V_2(T_K)/V_R \quad \text{Eq. (12)}$$

and such ratio $R_B/R_A$ is independent of the resistance of resistor $R_C$. That is, if $R_B/R_A=V_2(T_K)/V_R$, then the reference voltage $V_R$ is independent of the resistance of the resistor $R_C$. Hence, when the circuit 10 shown in FIG. 1 is fabricated as an integrated circuit the temperature coefficient of the Zener diode $S_Z$ is measured and the resistance of resistor $R_C$ is trimmed in accordance with, for example, conventional laser trimming techniques to satisfy Equation (9). More specifically, for example, when $V_R$ is 7.0 volts and $V_Z(T_K)$ is determined to be 1.75 volts, $R_B/R_A$, from Eq. (12), is $R_B/R_A=0.25$. Thus, here $R_A$ is 36.5K ohms and $R_B$ is 9.5K ohms. Further, here $R_D$ is 2.0K so that, in accordance with Eq. (9):

$$R_C=2\text{K ohms}\,[-2.0\text{ mV/°K.}+S_Z]/(-2.0\text{ mV/°K.})$$

where $S_Z$ is determined from the curves shown in FIG. 2 and $R_C$ is trimmed in accordance with the temperature coefficient $S_Z$ of the Zener diode fabricated in the circuit 10.

It is noted that the circuit described above is relatively simple in construction since it uses only a single transistor 26 between the Zener diode 28 and the first terminal 14 to control or regulate the level of the output voltage at output terminal 20. Further, since the compensating circuit $I_c$ passes through both the compensating resistor $R_c$ and the Zener diode 28 the configuration of the circuit 10 is adapted to produce an output voltage relatively close in value to the Zener breakdown voltage.

Having described a preferred embodiment of the invention it will now be apparent to one of skill in the art that other embodiments incorporating its concept may be used. It is felt therefore that this invention should not be restricted to the disclosed embodiment but rather should be limited only by the spirit and scope of the appended claims.

What is claimed is:

1. A temperature compensated voltage reference circuit, comprising:

(a) means for producing an output voltage at an output terminal comprising a reference voltage device connected between a predetermined voltage potential and the output terminal, such reference voltage device producing a reference voltage varying with temperature over a predetermined range temperatures; and (b) means, responsive to a compensating current, for producing a compensating voltage in series with the reference voltage, such compensating voltage varying inversely to the voltage variation of the reference voltage over the predetermined range of temperatures, such compensating current passing serially through the reference voltage device and the compensating voltage producing means.

2. A temperature compensated voltage reference circuit, comprising:

(a) a current source means, coupled to a first terminal, for supplying a predetermined amount of current to such first terminal;

(b) output voltage producing means, coupled between the first terminal and an output terminal, for producing an output voltage related to the amount of current flow from the first terminal to the output voltage producing means;

(c) current regulating circuit means, coupled between the output terminal and the first terminal, for controlling the amount of current flow from the first terminal to the output voltage producing means in accordance with the output voltage produced at the output terminal, such current regulating circuit means including a reference voltage means serially coupled between the output terminal and a predetermined voltage potential, the output voltage being related to the reference voltage produced by the reference voltage means, the reference voltage varying with temperature over a predetermined range of temperatures;

(d) temperature compensating circuit means, coupled to the output terminal and the reference voltage means, including means for producing a compensating voltage in series with the reference voltage produced by the reference voltage means in response to a compensating current, such produced compensating voltage varying in temperature over the predetermined range inversely to the temperature variation of the reference voltage, and wherein the compensating current flows serially through the compensating voltage producing means and the reference voltage producing means.

3. The temperature compensating voltage reference circuit recited in claim 2 wherein the reference voltage producing means includes a Zener diode.

4. The circuit recited in claim 3 wherein the compensating voltage producing means includes a resistor means.

5. A temperature compensated voltage reference circuit, comprising:

(a) a current source means, coupled to a first terminal, for supplying a predetermined amount of current to such first terminal;

(b) output voltage producing means, coupled between the first terminal and an output terminal, for producing an output voltage related to the amount of current flow from the first terminal to the output voltage producing means;

(c) a first resistor means connected to the output terminal;

(d) a reference voltage device serially connected to the resistor;

(e) a first transistor having a base electrode connected to the reference voltage device, an emitter electrode connected to a predetermined voltage potential, and a collector electrode connected to the first terminal;

(f) a second transistor having an emitter electrode connected to the output voltage producing means, a base electrode connected to the predetermined voltage potential and a collector electrode connected to a second terminal;

(g) a third transistor having a base electrode connected to the second terminal, and a collector electrode connected to the reference voltage device;

(h) a second resistor means connected between the second terminal and a second predetermined voltage potential; and (i) a third resistor means connected between an emitter electrode of the third transistor and the second predetermined voltage potential.

6. The temperature compensated voltage reference circuit recited in claim 5 wherein the reference voltage device is a Zener diode having: sense terminal anode and cathode electrodes serially connected between the base electrode of the first transistor and the first resistor means; and a force terminal anode electrode connected to the collector electrode of the third transistor.

7. The temperature compensated voltage reference circuit recited in claim 6 where the output voltage producing means includes a fourth and a fifth transistor having collector electrodes connected to a third predetermined voltage potential, the fourth transistor having an emitter electrode connected to both a base electrode of the fifth transistor and to the emitter electrode of the second transistor, and wherein an emitter electrode of the fifth transistor is connected to the output terminal.

8. The circuit recited in claim 7 including a fourth resistor means connected between the emitter electrode of the fourth transistor and the emitter electrode of the second transistor.

* * * * *

UNITED STATES PATENT OFFICE
CERTIFICATE OF CORRECTION

Patent No. 4,315,209 Dated February 9, 1982

Inventor(s) James C. Schmoock

It is certified that error appears in the above-identified patent and that said Letters Patent are hereby corrected as shown below:

Column 4, line 38, delete --approximatley-- and replace with --approximately--;

Column 5, Equation 7, delete --$V_R=R_C[(R_B/R_A)V_R-V_1(T_K)-S_T(T-T_K)]/R_D+V_1(T_K)+2S_T(T-T_K)+V_Z(T_K)+S_Z(T-T_K)$-- and replace with:

$$V_R = R_C\,[(R_B/R_A)\,V_R - V_1(T_K) - S_T\,(T - T_K)]/R_D + V_1(T_K) + S_T\,(T-T_K) + V_Z(T_K) + S_Z(T-T_K) \qquad \text{Eq. (7)}$$

Signed and Sealed this

First Day of June 1982

[SEAL]

Attest:

GERALD J. MOSSINGHOFF

Attesting Officer

Commissioner of Patents and Trademarks